US010689845B1

(12) United States Patent
Bilge

(10) Patent No.: US 10,689,845 B1
(45) Date of Patent: Jun. 23, 2020

(54) WALL SYSTEM

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 15/990,138

(22) Filed: May 25, 2018

(51) Int. Cl.
*E04B 2/74* (2006.01)
*E04B 2/72* (2006.01)
*E04B 1/18* (2006.01)

(52) U.S. Cl.
CPC ..... *E04B 2/7435* (2013.01); *E04B 1/185* (2013.01); *E04B 2/721* (2013.01); *E04B 2/723* (2013.01); *E04B 2002/7461* (2013.01); *E04B 2002/7485* (2013.01); *E04B 2002/7487* (2013.01)

(58) Field of Classification Search
CPC ..... E04B 2/7435; E04B 1/185; E04B 2/721; E04B 2/723; E04B 2002/7485; E04B 2002/7487; E04B 2002/7461
See application file for complete search history.

(56) References Cited

U.S. PATENT DOCUMENTS 2,169,253 A * 8/1939 Kotrbaty ..... E04B 2/845 52/693
2,169,254 A * 8/1939 Kotrbaty ..... E04B 2/62 52/364
3,626,650 A * 12/1971 Lickliter ..... E04F 13/0803 52/288.1
3,862,530 A * 1/1975 Martine ..... E04B 2/7854 52/281
4,546,584 A * 10/1985 Mieyal ..... E04B 2/7457 52/222
4,625,481 A * 12/1986 Crandell ..... E04F 13/0889 52/235
4,628,656 A * 12/1986 Menchetti ..... E04B 2/56 52/481.2
4,768,321 A * 9/1988 Crandell ..... E04F 13/0808 52/235
5,359,826 A * 11/1994 Grearson ..... E04C 3/07 403/363
6,968,661 B2 * 11/2005 Kopish ..... E04B 2/7457 52/481.1
7,168,213 B2 * 1/2007 Rudduck ..... A47B 91/02 52/235
7,810,294 B2 * 10/2010 Maley ..... E04B 9/064 52/220.6
9,631,364 B2 * 4/2017 Dobija ..... E04B 9/245
2004/0168382 A1 * 9/2004 Rudduck ..... A47B 91/02 52/238.1
2006/0075710 A1 * 4/2006 Maley ..... E04B 9/064 52/506.01

(Continued)

*Primary Examiner* — Rodney Mintz
(74) *Attorney, Agent, or Firm* — Richard M. Goldberg

(57) ABSTRACT

A building construction includes a plurality of vertically oriented studs, each extending between a floor and a ceiling of a building, each stud including a first and second stud sections in parallel, spaced apart relation, and a connecting wall which connects together the first and second stud sections in the parallel, spaced apart relation, each stud section including a central wall having lengthwise extending recesses, and two wing walls extending from opposite side edges of the central wall; and side connecting panels for connecting together wing walls of horizontally spaced apart studs, with the outer surface of each side connecting panel being coplanar with the outer surface of each respective central wall.

16 Claims, 18 Drawing Sheets

(56) References Cited

U.S. PATENT DOCUMENTS

2014/0075757 A1* 3/2014 Hager ..... E05B 65/006
29/897.32
2015/0007522 A1* 1/2015 Dobija ..... E04B 9/245
52/653.1

* cited by examiner

WALL SYSTEM

BACKGROUND OF THE INVENTION

The present invention relates generally to a wall system, and more particularly, to a system for easily erecting wall studs and connecting elements therefor.

Conventionally, walls are constructed by connecting floor to ceiling studs around the periphery of the room to be constructed, with the studs being separated from each other by distance of generally 16 inches. The studs can be 2×4 inch pieces of wood. Alternatively, the studs can be elongated sections of galvanized metal having a U-shaped, square or rectangular cross-section. After the studs are erected, sheetrock or the like is secured to the studs.

Although such an arrangement is relatively inexpensive, it is also labor intensive by requiring securement of the sheetrock to the studs by screws or the like.

In addition, such arrangement is not very versatile, for use, for example, in a situation for holding shelves or the like, for securing green walls thereto, for providing an exposed structure or the like.

SUMMARY OF THE INVENTION

Accordingly, it is an object of the present invention to provide a wall system that can be easily and economically erected.

It is another object of the present invention to provide a wall system that enables wall panels and the like to be readily secured thereto with only a minimal use of screws or the like.

It is still another object of the present invention to provide a wall system that is versatile for use in providing shelving, green walls or an open exposed wall structure.

In accordance with an aspect of the present invention, a building construction includes a plurality of vertically oriented studs, each extending upwardly from a floor of a building. Each stud includes a first stud section, a second stud section in parallel, spaced apart relation to the first stud section, and a connecting wall which connects together the first and second stud sections in the parallel, spaced apart relation. At least one of the first and second stud sections includes a central wall and at least one wing wall extending from a side edge of the central wall. There is also at least one side connecting panel for connecting together wing walls of horizontally spaced apart studs.

Preferably, the at least one of the first and second stud sections include two wing walls extending from opposite side edges of the central wall. Even more preferably, both of the first and second stud sections include a central wall, and two wing walls extending from opposite side edges of the central wall.

At least one of the central wall and at least one side connecting panel include recesses extending along a lengthwise direction thereof, for receiving securing elements secured to a rear surface of a wall panel in order to mount the wall panel to the building construction. Preferably, there are two parallel, spaced apart recesses in each central wall, and there are two parallel, spaced apart recesses in each side connecting panel.

Further, the outer surface of side connecting panel is coplanar with the outer surface of each respective central wall.

In one embodiment, the first stud section includes the central wall, and the at least one wing wall extending from a side edge of the central wall, and the connecting wall has one end fixedly connected to the central wall and forms part of the first stud section. The first stud section further includes a retaining wall fixed to an opposite end of the connecting wall, and the second stud section includes a retaining recess for receiving the retaining wall therein.

In this embodiment, the second stud section includes the central wall, the at least one wing extending from a side edge of the central wall, and at least one inward extension of the at least one wing, with all of the above defining the retaining recess.

In another embodiment, the connecting wall includes an elongated spacer wall having opposite side edges, and a retaining wall fixed to each side edge, and each of the first and second stud sections include the central wall, the at least one wing wall extending from a side edge of the central wall, and a retaining recess for receiving a respective retaining wall therein.

Further, each wing includes a recess for receiving an end of one side connecting plate therein.

There is also a top wall connected between two adjacent, spaced apart studs, and/or a bottom wall connected between two adjacent, spaced apart studs. Each top wall and bottom wall includes a central wall and opposite first and second end walls for engaging the connecting wall of each respective stud.

In one embodiment, a first end of at least one of the top wall and the bottom wall includes an L-shaped wall extending from the first end wall for receiving a second end wall of another respective top wall or bottom wall.

In another embodiment, there is an end wall securement member for engaging with a respective connecting wall, the end wall securement member including at least one wall for engaging with the respective connecting wall, and an L-shape wall extending from the at least one wall for receiving a second end wall of a respective top wall or bottom wall.

At a corner, according to one embodiment, a connecting element is positioned between the connecting wall and respective wing walls of the first and second stud sections, the connecting element including an engaging section for engaging the connecting wall of another first stud section, for forming the corner of a building. In such case, the engaging section includes walls which surround, hold and engage the connecting wall of the another first stud section.

There are also connecting elements for connecting two first stud sections together in vertical alignment, and two second stud sections together in vertical alignment.

The invention can further include shelving supported on two spaced apart side connecting panels for supporting items thereon.

The above and other features of the invention will become readily apparent from the following detailed description thereof which is to be read in connection with the accompanying drawings.

DETAILED DESCRIPTION

Figure 1:
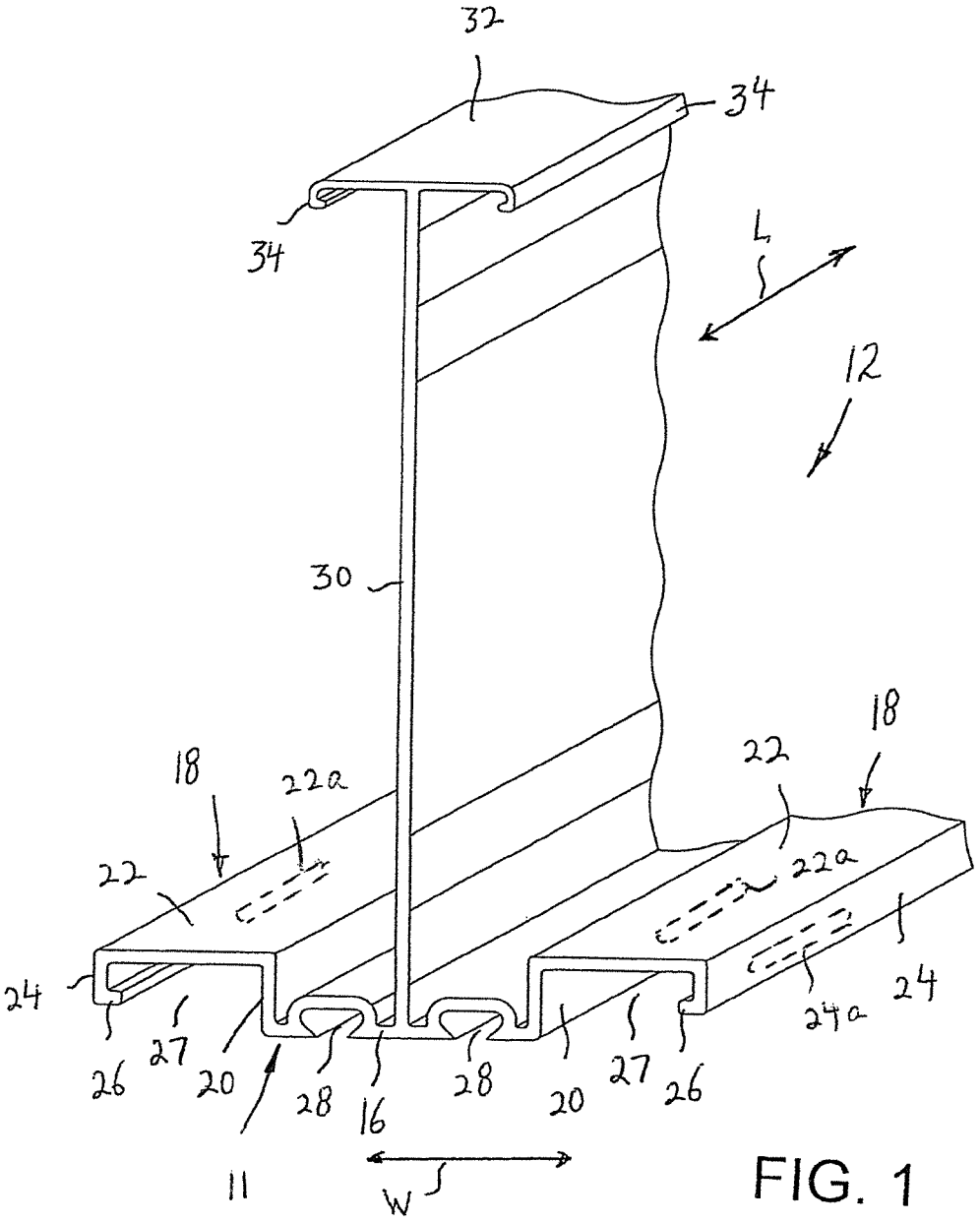
FIG. 1 is a perspective view of a first stud section of a stud according to the present invention.
Figure 2:
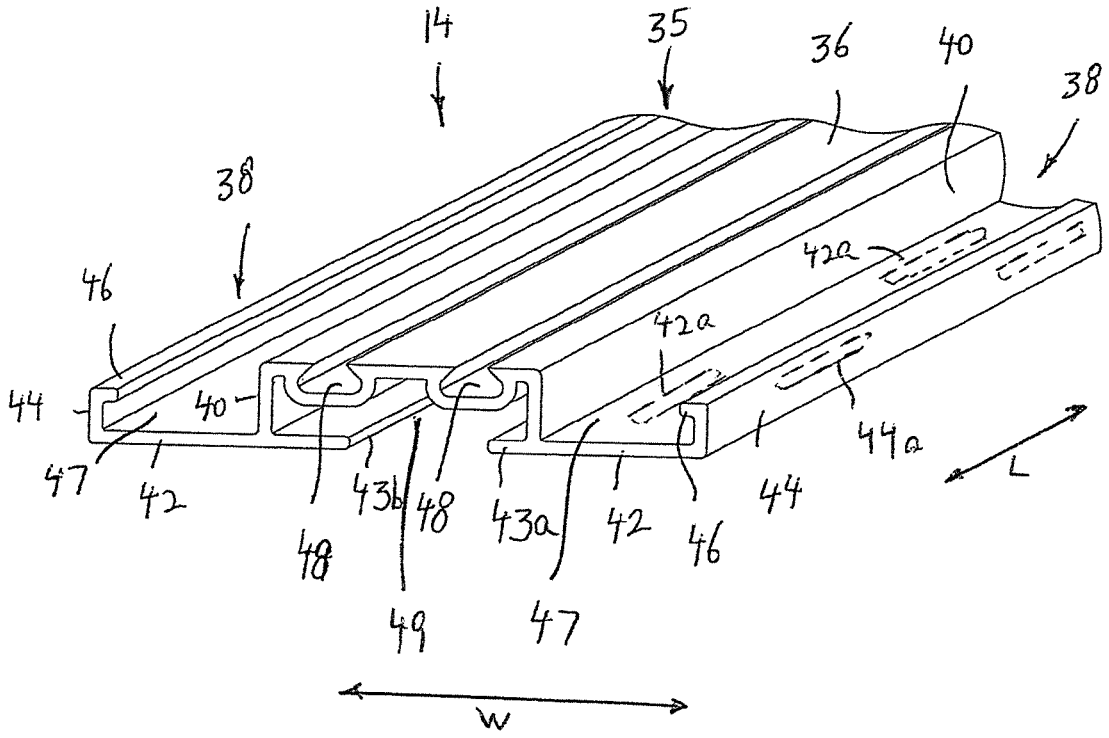
FIG. 2 is a perspective view of a second stud section of a stud according to the present invention.

Referring to the drawings in detail, and initially to FIG. 1 thereof, the basic stud 10 is constructed from first and second stud sections 12 and 14 shown in FIGS. 1 and 2.

Specifically, stud section 12 includes an end flange 11 having a central planar wall 16, with a wing wall 18 connected at each end edge of central planar wall 16. Each wing wall 18 extends for the entire length of central planar wall 16.

Each wing wall 18 includes a first planar limiting wall 20 that extends inwardly from the respective end edge of central planar wall 16 at a right angle thereto, and a second planar resting wall 22 that extends outwardly from the free end of first planar limiting wall 20 so as to be parallel and offset from central planar wall 16. A third planar catch wall 24 extends outwardly from the free end of second planar resting wall 22 in parallel, spaced relation to first planar limiting wall 20 but has a lesser depth than first planar limiting wall 20 such that the free end thereof is spaced inwardly from the plane of central planar wall 16. Lastly, a fourth planar tab wall 26 extends inwardly from the free end of third planar catch wall 24 in facing relation to first planar limiting wall 20 so as to be in parallel, spaced apart relation from second planar resting wall 22. It will be appreciated that walls 20, 22, 24 and 26 form a U-shaped recess 27.

It will be appreciated that all of the above walls 16, 18, 20, 22, 24 and 26 extend vertically in a lengthwise direction L which is much greater than the widthwise direction W. For example, each of the above walls can extend eight feet or longer in the lengthwise direction L to be connected between a floor and ceiling of a room, or merely free standing on a floor. Alternatively, and preferably, the above walls extend for smaller sections, for example, in four foot lengths in the lengthwise direction L, and are connected to corresponding walls of another first stud section 12, as will be discussed hereinafter.

Further, two trapezoidal shaped recesses 28 are formed in the outer facing surface of central planar wall 16 in parallel, spaced relation to each other and extending in the lengthwise direction L. Each trapezoidal shaped recess 28 extends along the entire length of central planar wall 16. However, recesses 28 can have any suitable shape, and are not limited to the trapezoidal shape.

An elongated spacer wall or web wall 30 extends in a perpendicular manner from the inner surface of central planar wall 16 at a position between and parallel to trapezoidal shaped recesses 28.

A planar retaining wall 32 is connected to the opposite, free end of elongated spacer wall 30 in parallel, spaced apart relation to central planar wall 16. An elongated L-shaped wall 34 extends inwardly from each lateral free edge of planar retaining wall 32 and along the entire length thereof.

Second stud section 14 is formed in a similar manner to first stud section 12, and preferably extends for the same length as first stud section 12.

Specifically, second stud section 14 includes an end flange 35 having a central planar wall 36, with a wing wall 38 connected at each end edge of central planar wall 36. Each wing wall 38 extends for the entire length of central planar wall 36.

Each wing wall 38 includes a first planar limiting wall 40 that extends inwardly from the respective end edge of central planar wall 36 at a right angle thereto, and a second planar resting wall 42 that extends outwardly from the free end of first planar limiting wall 40 so as to be parallel and offset from central planar wall 36. A third planar catch wall 44 extends outwardly from the free end of second planar resting wall 42 in parallel, spaced relation to first planar limiting wall 40 but has a lesser depth than first planar limiting wall 40 such that the free end thereof is spaced inwardly from the plane of central planar wall 36. Lastly, a fourth planar tab wall 46 extends inwardly from the free end of third planar catch wall 44 in facing relation to first planar limiting wall 40 so as to be in parallel, spaced apart relation from second planar resting wall 42. It will be appreciated that walls 40, 42, 44 and 46 form a U-shaped recess 47.

It will be appreciated that all of the above walls 36, 38, 40, 42, 44 and 46 extend vertically in a lengthwise direction L which is much greater than the widthwise direction W. For example, each of the above walls can extend eight feet or longer in the lengthwise direction L to be connected between a floor and ceiling of a room. Alternatively, and preferably, the above walls extend for smaller sections, for example, in four foot lengths in the lengthwise direction L, and all connected to corresponding walls of another second stud section 14, as will be discussed hereinafter.

Further, two trapezoidal shaped recesses 48 are formed in the outer facing surface of central planar wall 36 in parallel, spaced relation to each other and extending in the lengthwise direction L. Each trapezoidal shaped recess 48 extends along the entire length of central planar wall 36. However, recesses 48 can have any suitable shape, and are not limited to the trapezoidal shape.

In addition, second planar resting wall 42 has an inward extension 43*a* or 43*b* that extends inwardly of first planar limiting wall 40 in parallel spaced relation to central planar wall 36 and trapezoidal shaped recesses 48. It will be appreciated that one inward extension 43*a* has a small width than the other inward extension 43*b*. This provides that planar retaining wall 32 can be angled into recess 49 and then slid therein, so as to effectively lock planar retaining wall 32 in recess 49.

Figure 3:
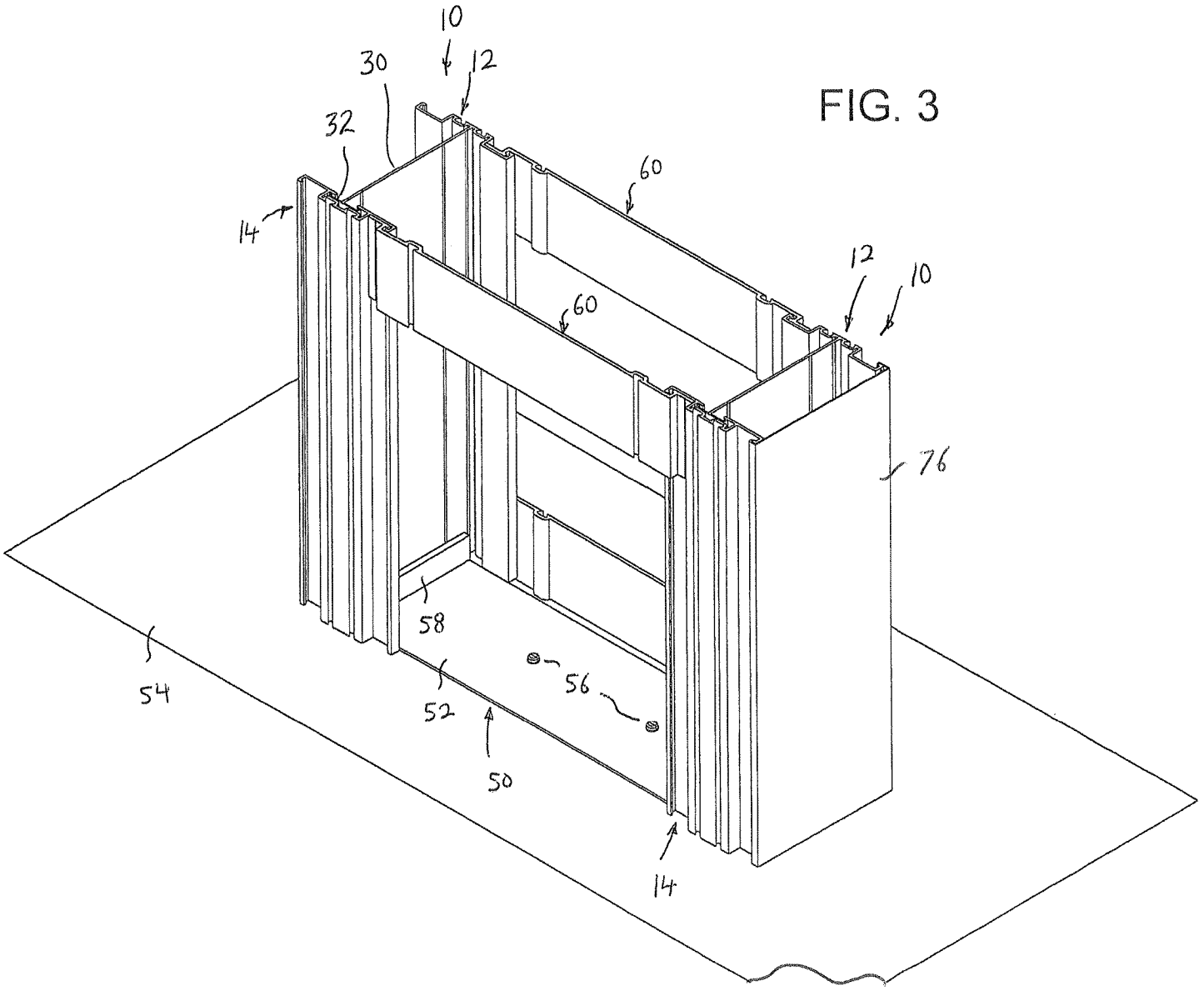
FIG. 3 is a perspective view of two studs assembled on a floor and connected together by connecting panels.

With this arrangement, as shown in FIG. 3, planar retaining wall 32 slides within the retaining recess 49 formed between first planar limiting walls 40, inward extensions 43 and trapezoidal shaped recesses 48. First and second stud sections 12 and 14 can be connected together by screws extending through planar retaining wall 32 into central planar wall 36, although such securement is unnecessary with the present invention as will be understood from the discussion hereafter.

Figure 4:
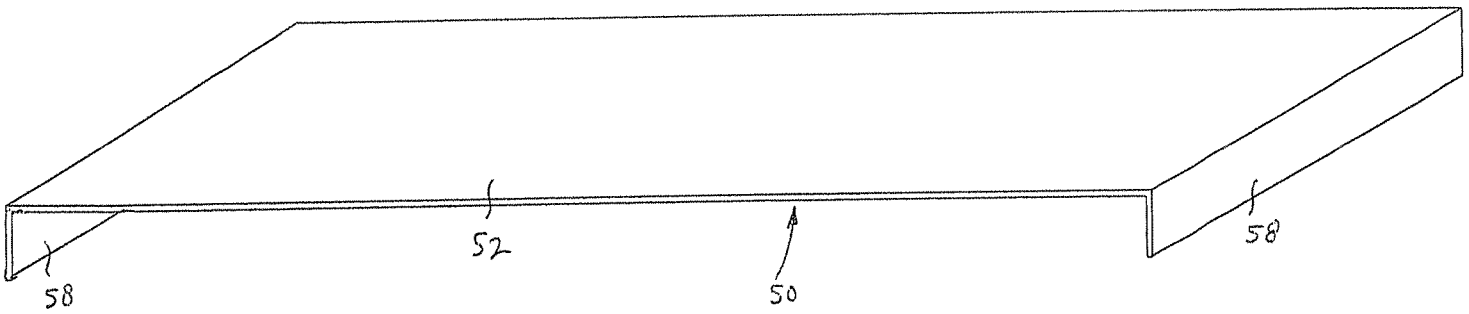
FIG. 4 is a perspective view of an elongated bottom wall that connects adjacent studs together.

When utilizing studs 10, as shown in FIGS. 3 and 4, in a building construction, an elongated U-shaped bottom wall 50 has its central wall 52 secured to a floor 54 of the building by fastening elements 56, such as screws or the like, with its end walls 58 turned upwardly. However, bottom walls 50 are not required, and can be eliminated. Each stud 10 is positioned to the outside of each end wall 58, and specifically, elongated spacer wall 30 is positioned to the outside and against the outer surface of a respective end wall 58. Preferably, studs 10 are separated from each other by a distance of 16 inches as is conventional, although the present invention is not limited thereto. Screws (not shown) can be used to secure end walls 58 to elongated spacer walls 30, although this is not required by the present invention.

Figure 5:
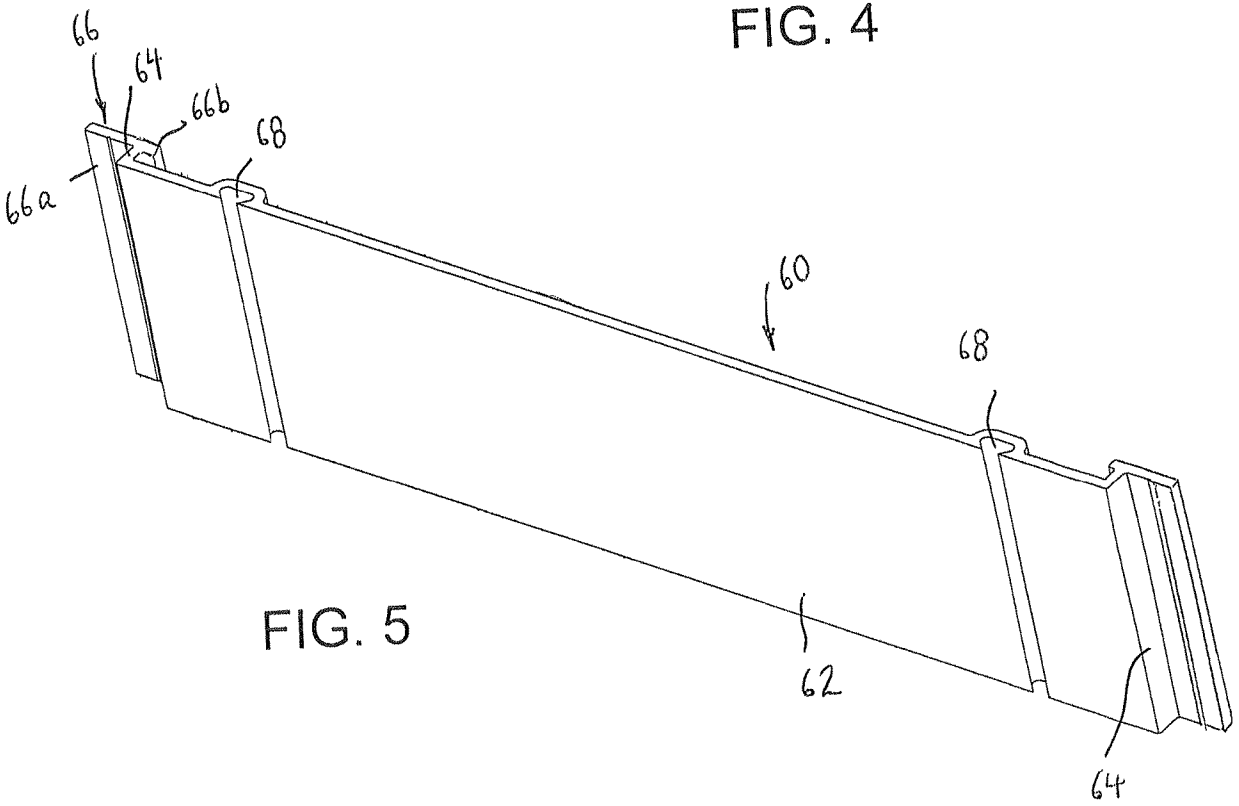
FIG. 5 is a perspective view of a connecting panel.

Elongated side connecting panels 60 connect together adjacent studs 10, as shown in FIGS. 3 and 5. Specifically, as shown in FIG. 5, each side connecting panel 60 includes an elongated planar wall 62 with inwardly extending end walls 64 at opposite ends thereof. Planar capture walls 66 are secured to the inner free ends of end walls 64 so as to be in parallel, spaced apart relation from elongated planar wall 62. Planar capture walls 66 each include an outer wall section 66*a* that extends outwardly of the respective end wall 64 and an inner wall section 66*b* that extends inwardly of the respective end wall 64. In addition, two trapezoidal shaped recesses 68 are formed in the outer facing surface of elongated planar wall 62 in parallel, spaced relation to each other and extending in the vertical direction when assembled. However, recesses 68 can have any suitable shape, and are not limited to the trapezoidal shape.

Thus, each planar capture wall 66 is adjacent to, or seats flush against, the outer surface of second planar resting wall 22 or 42, with inner wall section 66*b* captured by planar tab wall 26 or 46. In such position, screws (not shown) can be inserted through outer wall section 66*a* and second planar resting wall 22 or 42. However, other securing means can be used, such as double sided adhesive tape, for example, as sold by The 3M Company, or any other mechanical arrangement.

Figure 5A:
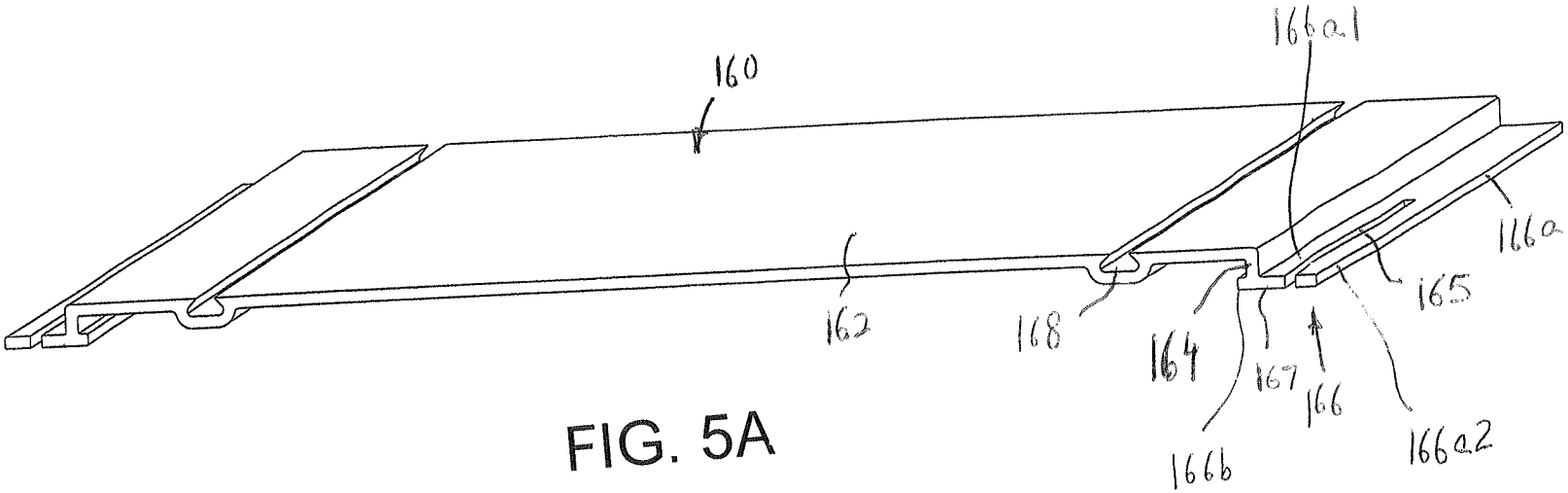
FIG. 5A is a perspective view of a modified connecting panel.

For example, as a mechanical arrangement, as shown in FIGS. 1, 2 and 5A, a modified side connecting panel 160 includes an elongated planar wall 162 with inwardly extending end walls 164 at opposite ends thereof. Planar capture walls 166 are secured to the inner free ends of end walls 164 so as to be in parallel, spaced apart relation from elongated planar wall 162. Planar capture walls 166 each include an outer wall section 166*a* that extends outwardly of the respective end wall 164 and an inner wall section 166*b* that extends inwardly of the respective end wall 164. In addition, two trapezoidal shaped recesses 168 are formed in the outer facing surface of elongated planar wall 162 in parallel, spaced relation to each other and extending in the vertical direction when assembled. However, recesses 168 can have any suitable shape, and are not limited to the trapezoidal shape.

Elongated slots 165 are provided in outer wall section 166*a* and are open at one edge 167 centrally thereof and extending about one-half the length thereof. As a result, elongated slots 165 divide outer wall sections 166*a* into an inner slide wall section 166*a* and an outer slide wall section 166*a*2.

In this manner, outer slide wall sections 166*a*2 are inserted through respective slots 24*a* or 44*a* in third planar catch walls 24 or 44, to removably lock connecting panels 160 to first stud section 12 or second stud section 14.

Figure 5B:
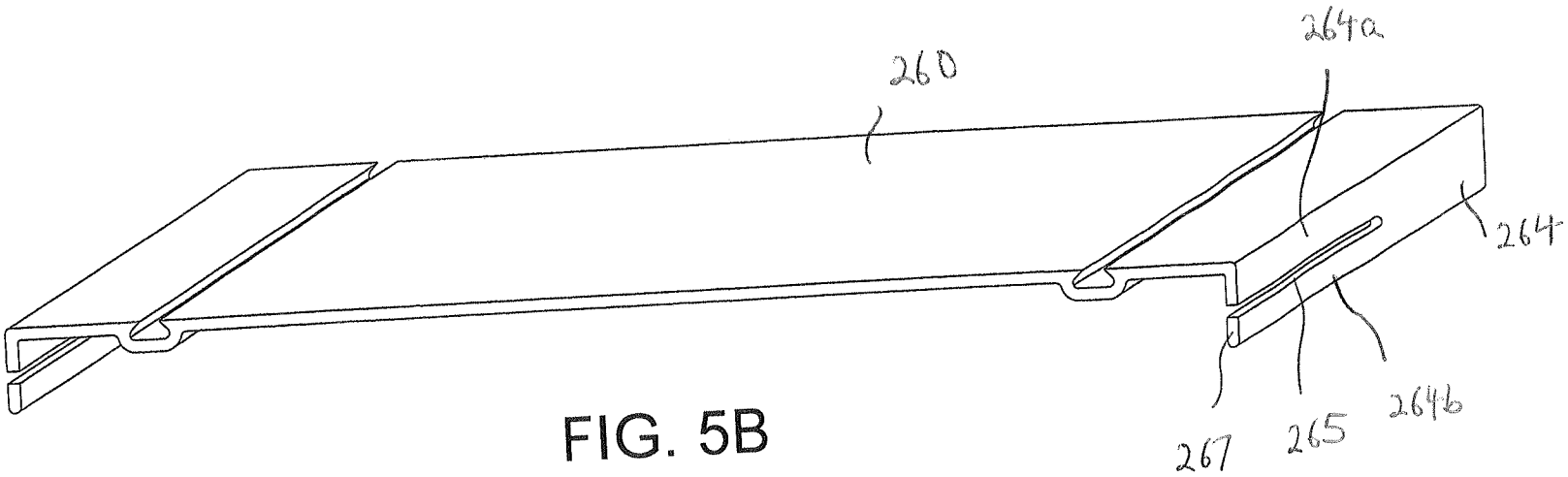
FIG. 5B is a perspective view of a further modified connecting panel.

A further modified side connecting panel 260 is shown in FIG. 5B. Each connecting panel 260 eliminates planar capture walls 66, and slightly extends the length of inwardly extending walls 264.

Elongated slots 265 are provided in inwardly extending walls 264 and are open at one edge 267 centrally thereof and extending about one-half the length thereof. As a result, elongated slots 265 divide inwardly extending walls 264 into an inner slide wall section 264*a* and an outer slide wall section 266*b*.

In this manner, outer slide wall sections 266*b* are inserted through respective slots 22*a* or 42*a* in second planar resting walls 22 or 42, to removably lock connecting panels 260 to first stud section 12 or second stud section 14.

It will be appreciated that the outer surface of each side connecting wall 60 is preferably coplanar with the outer surface of each central planar wall 16 or 36.

Figure 6:
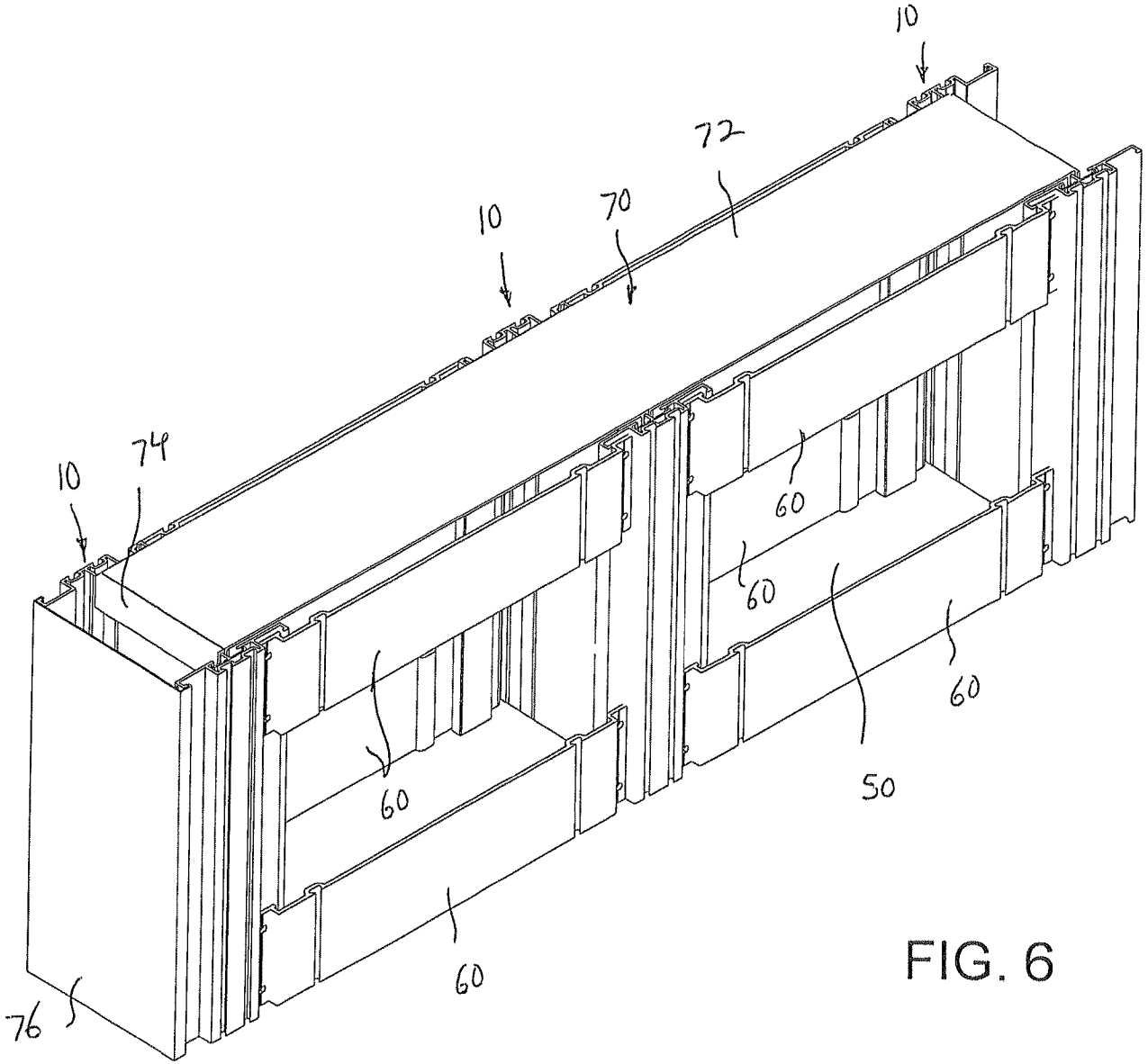
FIG. 6 is a perspective view of three studs assembled on a floor and connected together by connecting panels and a single bottom wall and a single top wall.

An elongated U-shaped top wall 70, as shown in FIG. 6, which is identical to elongated U-shaped bottom wall 50, can be mounted on top of elongated spacer walls 30. Top wall 70 can be secured to a ceiling, or ceiling studs, of the building. However, it is not necessary, for example, if the height of studs 10 is less than the ceiling height. Thus, elongated U-shaped top wall 70 is formed with an elongated central wall 72 and opposite end walls 74 positioned in overlapping relation to the upper end of elongated spacer wall 30, and which can be secured thereto by screws or the like.

Further, as shown in FIGS. 3 and 6 at an end corresponding to a corner, U-shaped end finishing cap walls 76 can be secured around planar tab walls 26 and 46.

Figure 7:
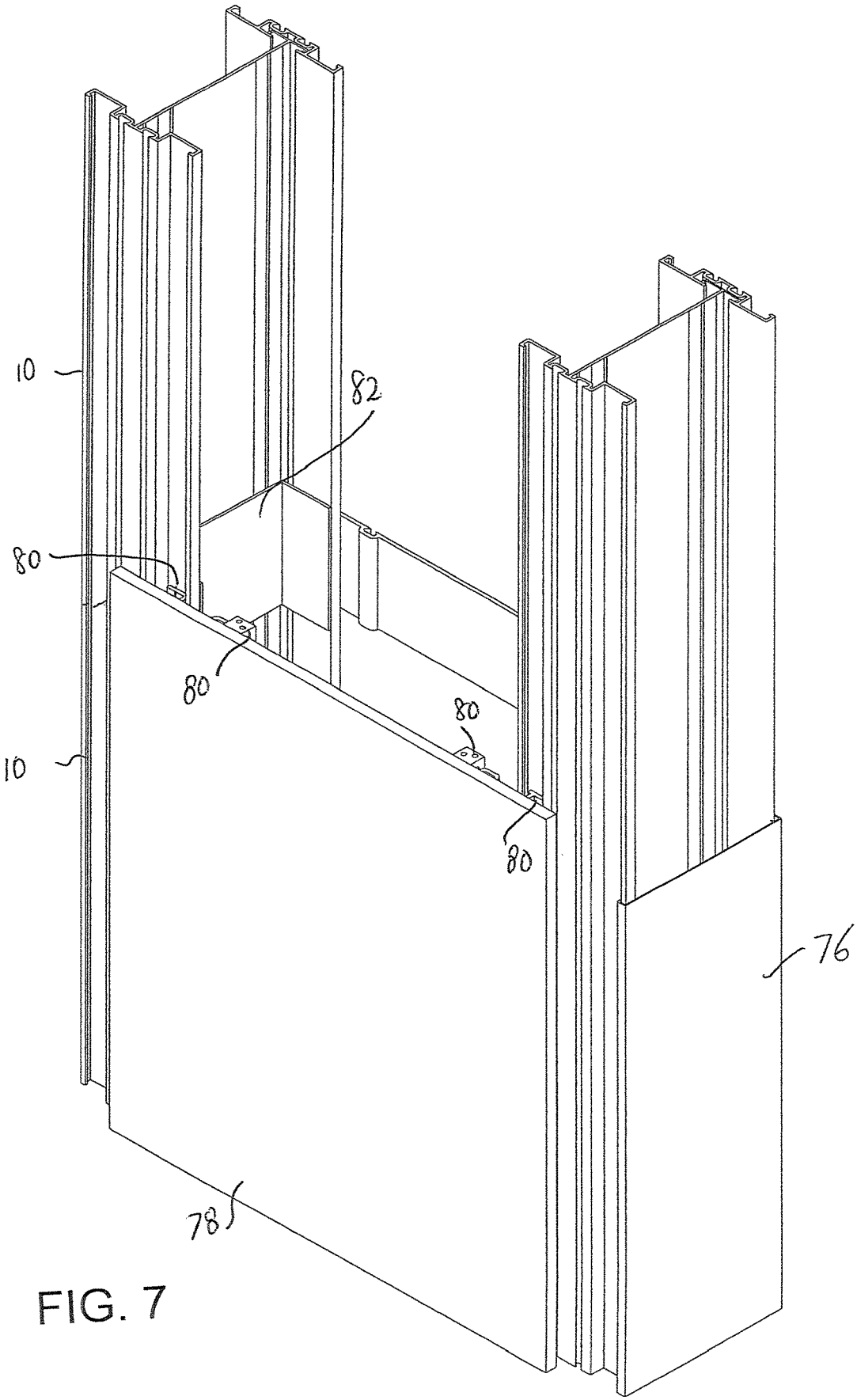
FIG. 7 is a perspective view of two studs connected together by connecting panels, with the each stud formed by different vertical sections connected together, and a wall panel and cap wall thereon.

With this arrangement, as shown in FIG. 7, wall panels 78 can be secured to studs 10 and/or elongated side connecting panels 60. In this regard, each wall panel 78 preferably includes elements 80 on the inner surface thereof which slide within trapezoidal shaped recesses 28 or 48, trapezoidal shaped recesses 68 and/or recesses 27 or 47, and can be secured by screws, although this is not necessary with the present invention. Elements 80 can take any suitable form, including but not limited to a trapezoidal cross-section, a T-shaped cross-section, etc.

In addition, multiple studs 10 can be stacked upon each other in a vertical direction and secured to each other. Thus, the studs 10 can be constructed of a shorter length for easy transport and then secured together. This also permits easy securement of the wall panels 78 to studs 10. In this regard, as shown in FIG. 7, two studs 10 are shown stacked upon each other, with a U-shaped connecting member 82 at the inner walls of studs 10 at the intersection thereof. U-shaped connecting member 78 is secured to the walls of studs 10 by screws, adhesive tape or any other securing means (not shown).

Figure 8:
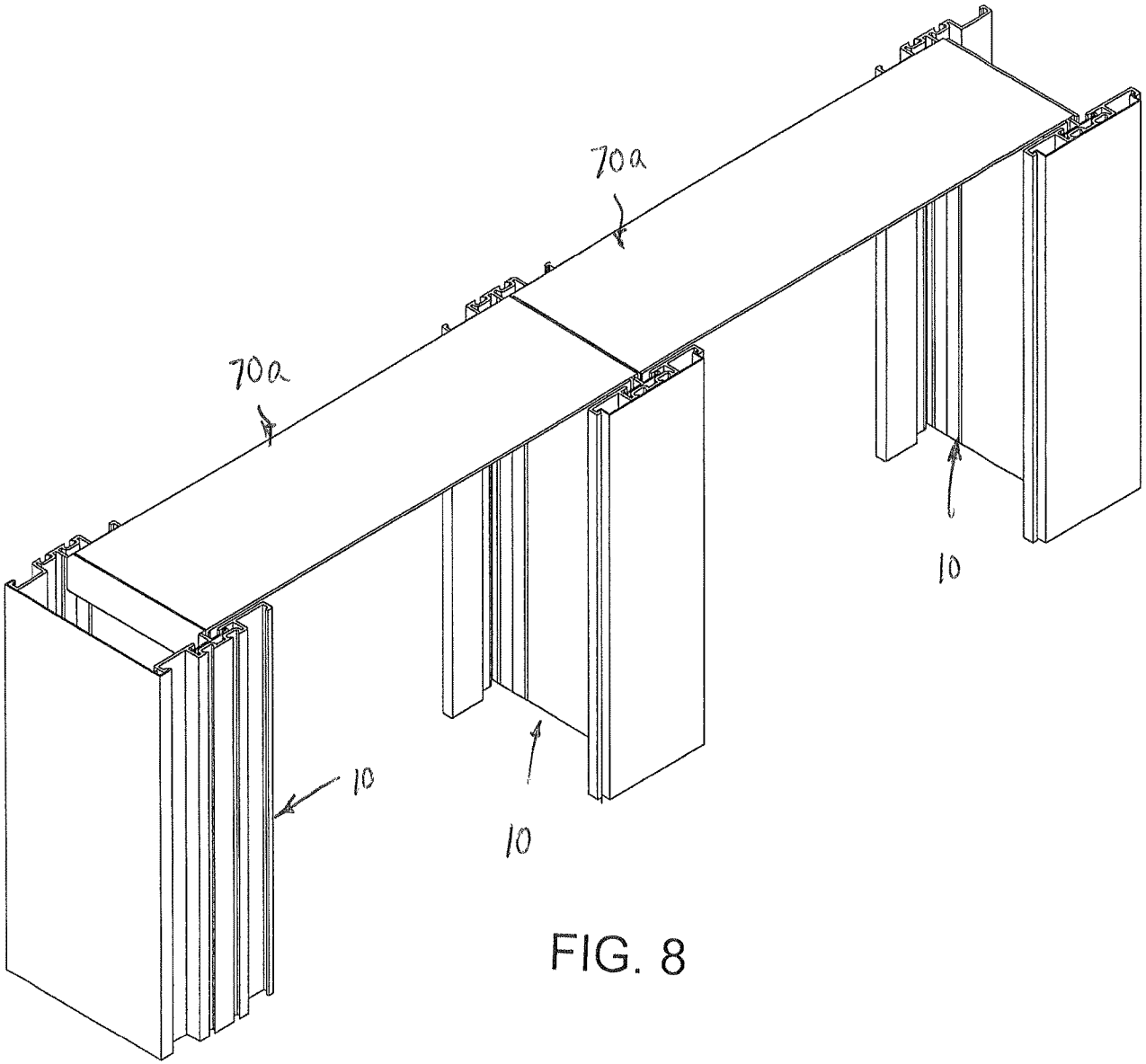
FIG. 8 is a perspective view of three studs assembled on a floor and connected together by two modified top walls, and with the connecting walls removed for clarity.

As shown in FIG. 6, elongated U-shaped top wall 70 spans a distance of three separated studs 10. However, from a practical standpoint, it is best that the elongated U-shaped top wall connect together only two adjacent studs 10. Such an arrangement is shown in FIG. 8.

Figure 9:
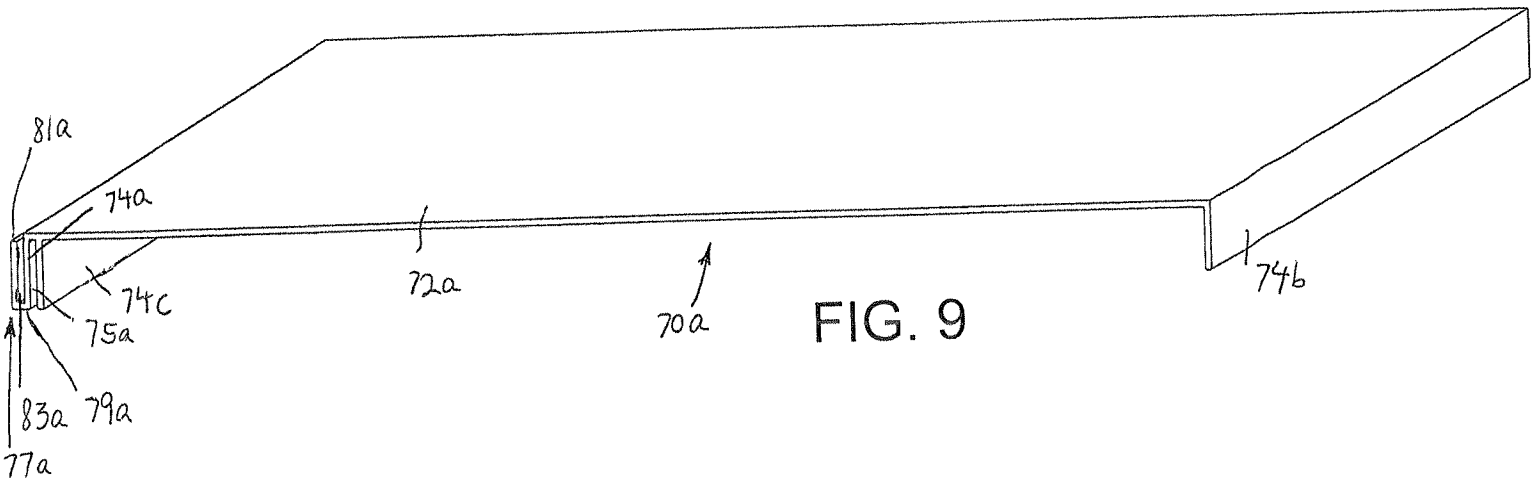
FIG. 9 is a perspective view of a modified top wall of FIG. 8.
Figure 10:
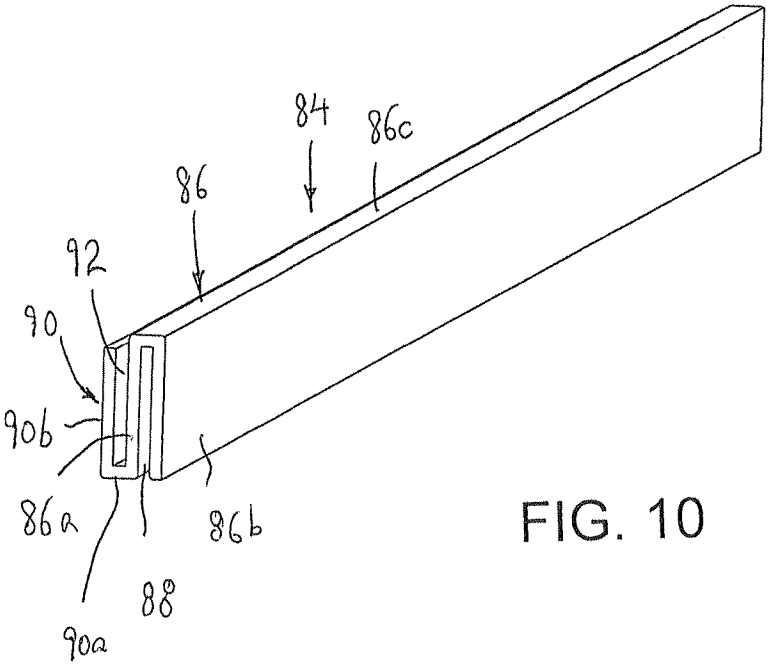
FIG. 10 is a perspective view of an end wall securement member.

In this regard, a modified elongated U-shaped top wall 70*a* therefor is shown in FIG. 9. Modified elongated U-shaped top wall 70*a* is formed with an elongated central wall 72*a* and opposite end walls 74*a* and 74*b* positioned in overlapping relation to the upper end of elongated spacer walls 30, and which can be secured thereto by screws or the like. In addition, a further end wall 74*c* extends from the underside of the elongated central wall 72*a* in parallel, spaced relation to end wall 74*a*, and spaced slightly inwardly therefrom, to define a recess 75*a* therebetween which receives the upper end of a respective elongated spacer wall 30. In addition, an L-shaped wall 77*a* has a short stub wall 79*a* connected to the lower end of end wall 74*a*, and a further end wall 81*a* extending upwardly therefrom in parallel, spaced apart relation to end wall 74*a* to define a recess 83*a* between walls 74*a* and 81*a* to receive the end wall 74*b* of another modified elongated U-shaped top wall 70*a*, and so on. The same arrangement can be provided for the bottom wall 50.

In the case of a starting point and an end point of a wall to be formed, an end wall securement member 84 can be provided which includes an inverted U-shaped wall 86 formed by two parallel, spaced apart walls 86*a* and 86*b* connected at the upper ends by a connection wall 86*c* and defining a recess 88 therebetween which engages over the upper end of an elongated spacer wall 30. An L-shaped wall 90 has a short stub wall 90*a* connected to the lower end of end wall 86*a*, and a further end wall 90*b* extending upwardly therefrom in parallel, spaced apart relation to end wall 86*a* to define a recess 92 between walls 86*a* and 90*b* to receive the end wall 74*b* of another modified elongated U-shaped top wall 70*a*.

Figure 11:
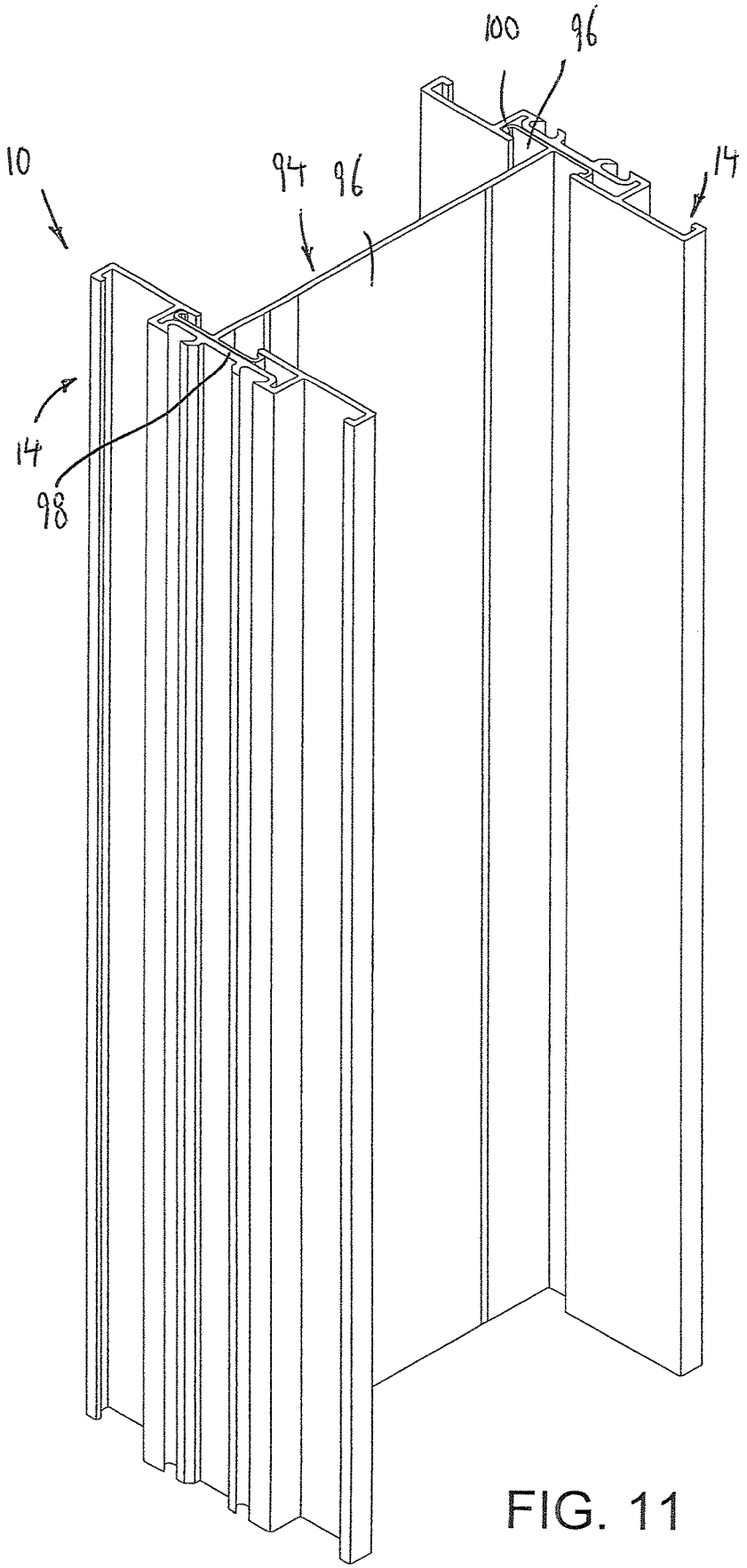
FIG. 11 is a perspective view of a modified stud according to the present invention.
Figure 12:
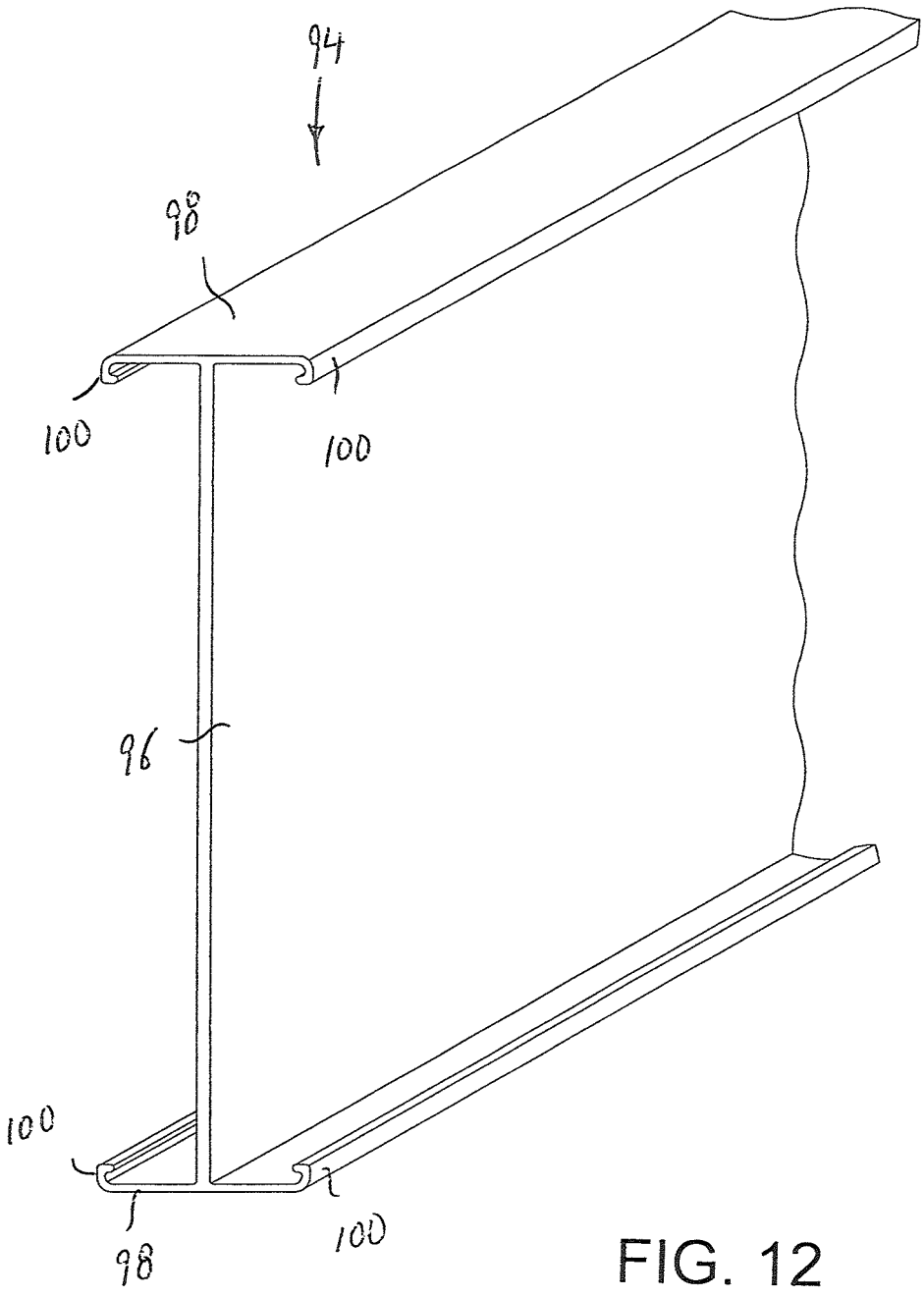
FIG. 12 is a perspective view of the connection element of the modified stud of FIG. 11.

Alternatively, rather than connecting first stud section 12 and second stud section 14 together to form a basic stud 10, two second stud sections 14 can be connected together by a connection element 94, as shown in FIGS. 11 and 12. Specifically, connection element 94 includes an elongated spacer wall 96 and a planar retaining wall 98 connected to each of the opposite, free ends of elongated spacer wall 96. Each planar retaining wall 98 is connected at a right angle to elongated spacer wall 96 and is bisected by elongated spacer wall 96. An elongated L-shaped wall 100 extends inwardly from each lateral free edge of each planar retaining wall 98 and along the entire length thereof.

With this arrangement, as shown in FIG. 11, each planar retaining wall 98 slides within the recess formed between first planar limiting walls 40, inward extensions 43 and trapezoidal shaped recesses 48 of a respective second stud section 14. Preferably, screws extend through each planar retaining wall 98 into central planar wall 36, although such securement is unnecessary with the present invention as will be understood from the discussion hereafter.

Figure 13:
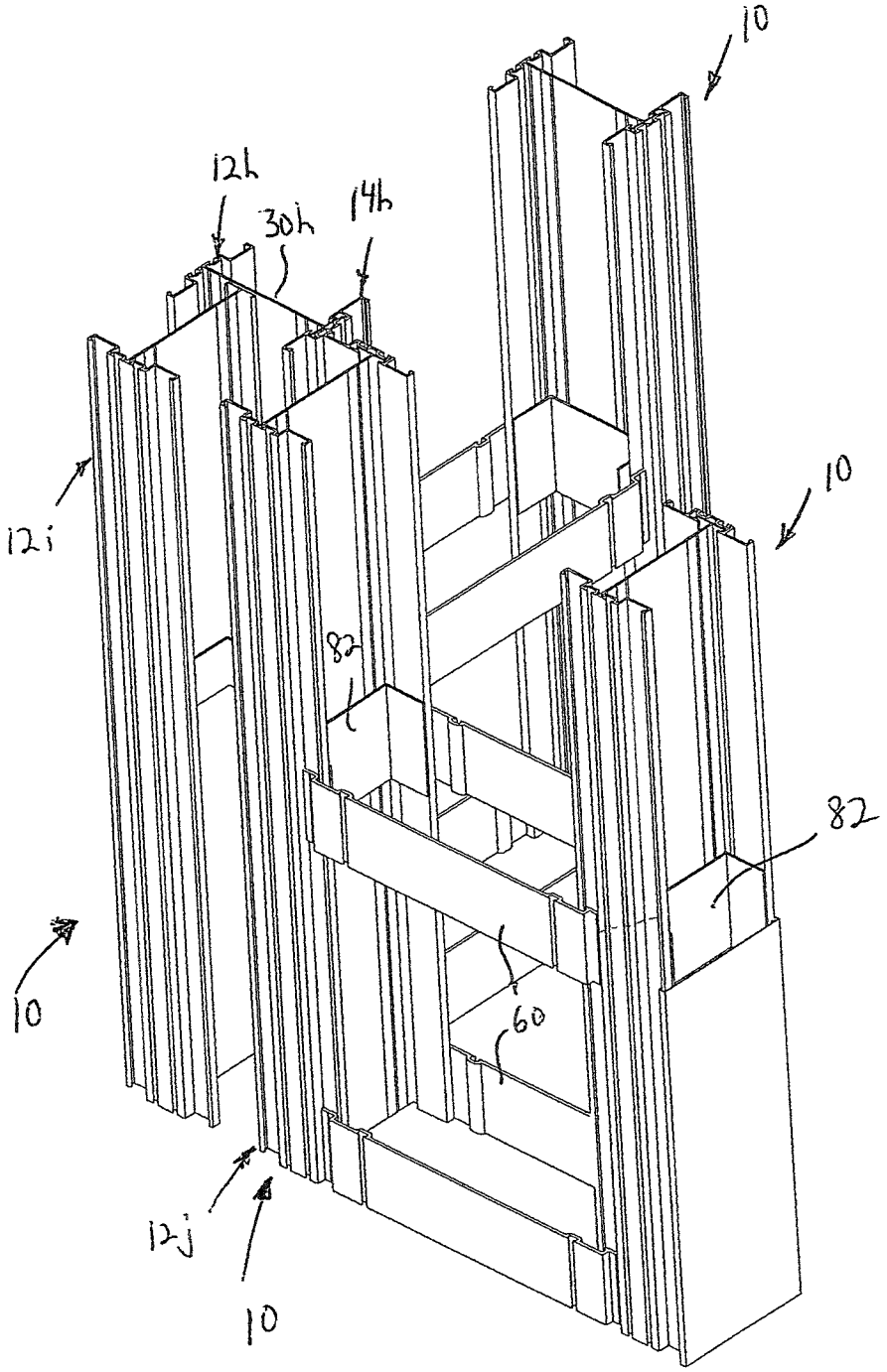
FIG. 13 is a perspective view of a corner formed by the studs according to the present invention.
Figure 14:
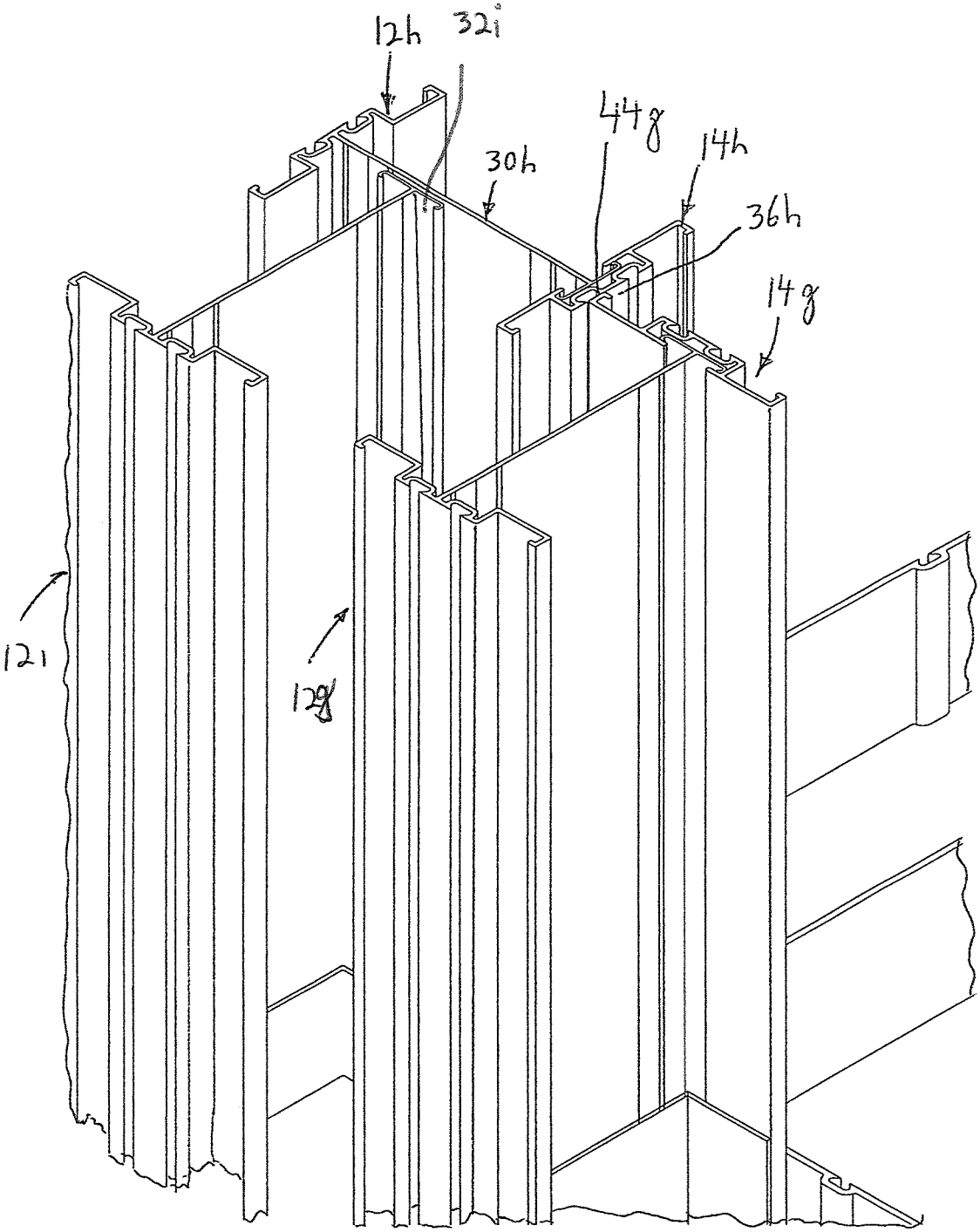
FIG. 14 is an enlarged perspective view of the upper left section of FIG. 13.

FIGS. 13 and 14 show use of the above studs 10 at a corner, with FIG. 14 being an enlarged section of FIG. 13. In this case, a third planar catch wall 44*g* of a second stud section 14*g* abuts against a central planar wall 36*h* of another second stud section 14*h* at right angles to first stud section 14*g*. In addition, a first stud section 12*i* which is spaced from another first stud section 12*g* has its planar retaining wall 32*i* positioned against elongated spacer wall 30*h* of a first stud section 12*h* connected with second stud section 14*h*, and can be connected by screws or the like.

However, in the latter arrangement, second stud section 14*h* is not connected with second stud section 14*g*, so that they are free standing relative to each other, although they can be connected by screws if desired. However, side connected panels 60, bottom wall 50 and top wall 70 can connect together first stud sections 12*g* and 12*i*. This is shown in FIG. 16 hereafter.

Figure 15:
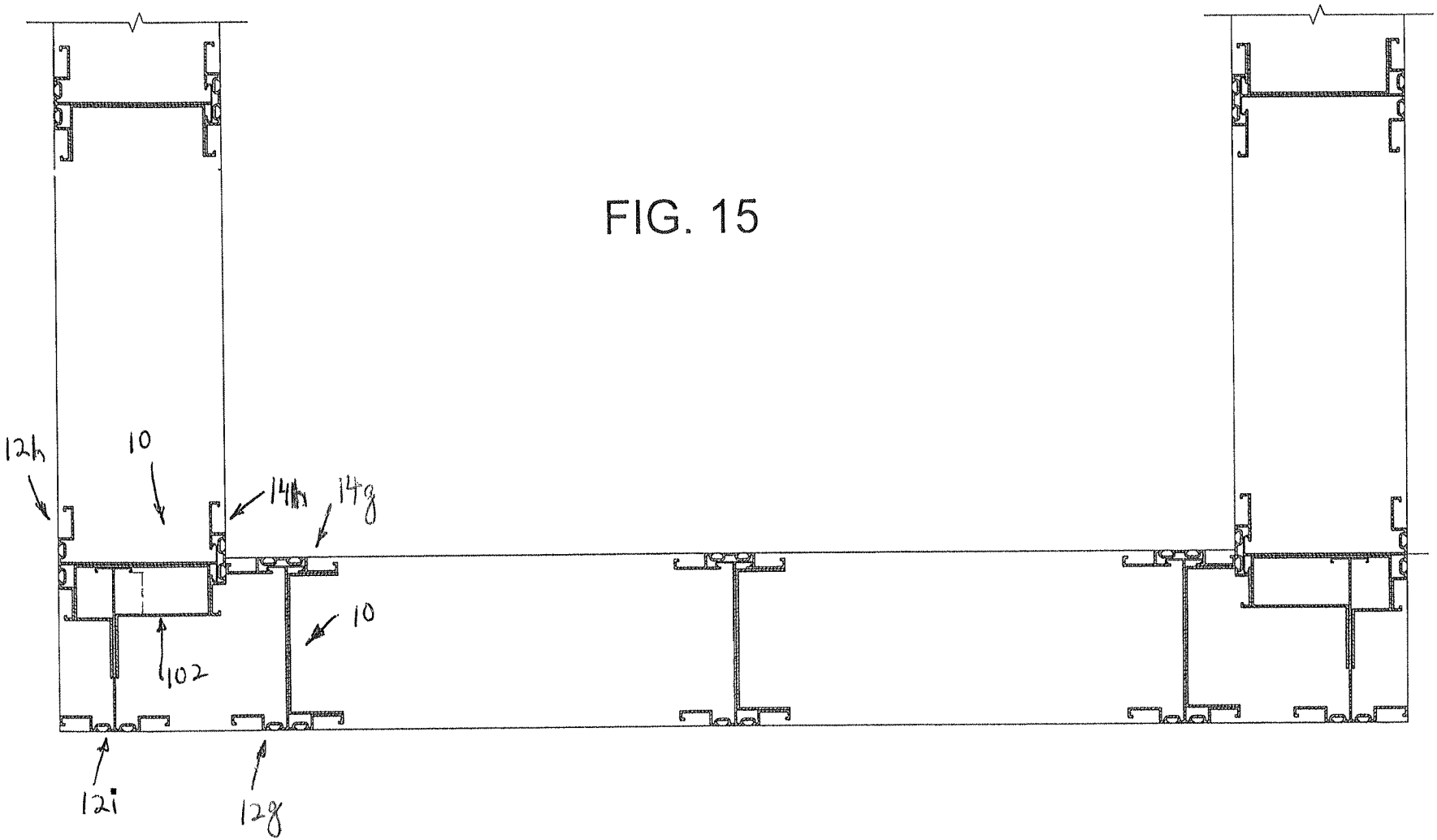
FIG. 15 is a top plan view, in section, of a three orthogonal walls of a room formed by the studs according to the present invention.
Figure 16:
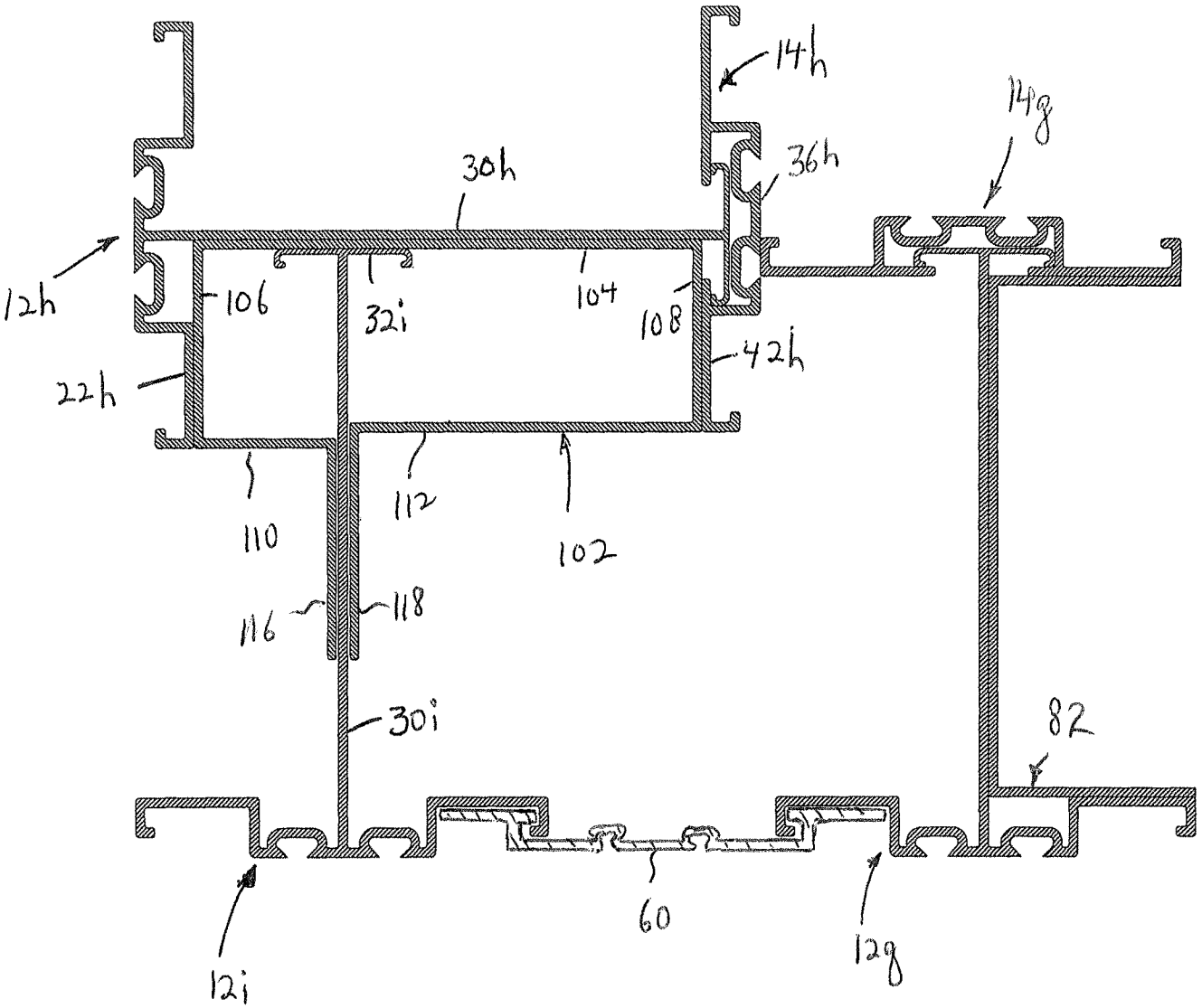
FIG. 16 is an enlarged perspective view of the lower left corner of FIG. 15.
Figure 17:
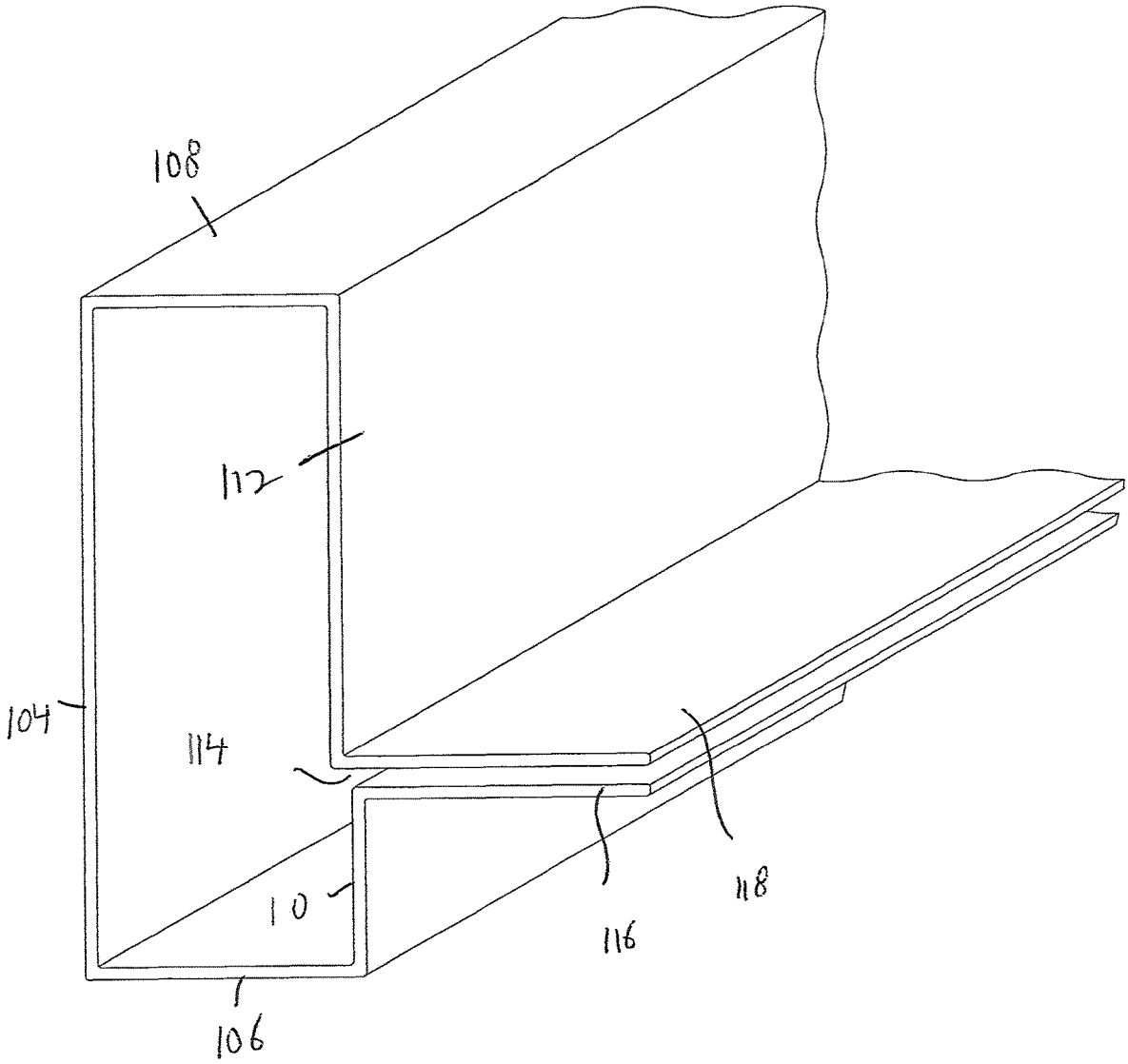
FIG. 17 is a perspective view of the corner collecting element of FIG. 16.

FIGS. 15-17 show a different corner arrangement in which FIG. 16 shows an enlarged section at the lower left corner of FIG. 15. The elongated side connecting panels 60 are eliminated from these drawings for better understanding.

Basically, the corner arrangement of FIGS. 15-17 is identical to that of FIGS. 13 and 14, with the addition of a connecting element 102, as will now be described.

As shown therein, first stud section 12*h* is connected to second stud section 14*h* at a corner. A connecting element 102 is positioned against elongated spacer wall 30*h* and second planar resting wall 22*h* of first stud section 12*h* and against second planar resting wall 42*h* of second stud section 14*h*. Specifically, connecting element 102 includes a first planar wall 104 positioned against elongated spacer wall 30*h*, a second planar wall 106 extending at a right angle from one end of first planar wall 104 and positioned against second planar resting wall 22*h* and a third planar wall 108 extending at a right angle from the opposite end of first planar wall 104 and positioned against second planar resting wall 42*h*. These walls can be connected together by screws (not shown) if desired. A fourth planar wall 110 extends inwardly from the free end of second planar wall 106 so as to be in parallel, spaced relation from first planar wall 104 and a fifth planar wall 112 extends inwardly from the free end of third planar wall 108 so as to be in parallel, spaced relation from first planar wall 104. The free ends of fourth and fifth planar walls 110 and 112 are spaced slightly away from each other to provide a gap 114 therebetween. Two parallel, spaced apart planar walls 116 and 118 extend at right angles from the free ends of planar walls 110 and 112 in a direction away from first planar wall 104, and are therefore separated by the same gap 114.

Another first stud section 12*i* has its elongated spacer wall 30*i* extending through the gap 114 such that its planar retaining wall 32*i* seats flush against first planar wall 104, although it need not be flush. This provides additional stability to the structure. Screws can be inserted through planar wall 116, elongated spacer wall 30*i* and planar wall 118.

Figure 18:
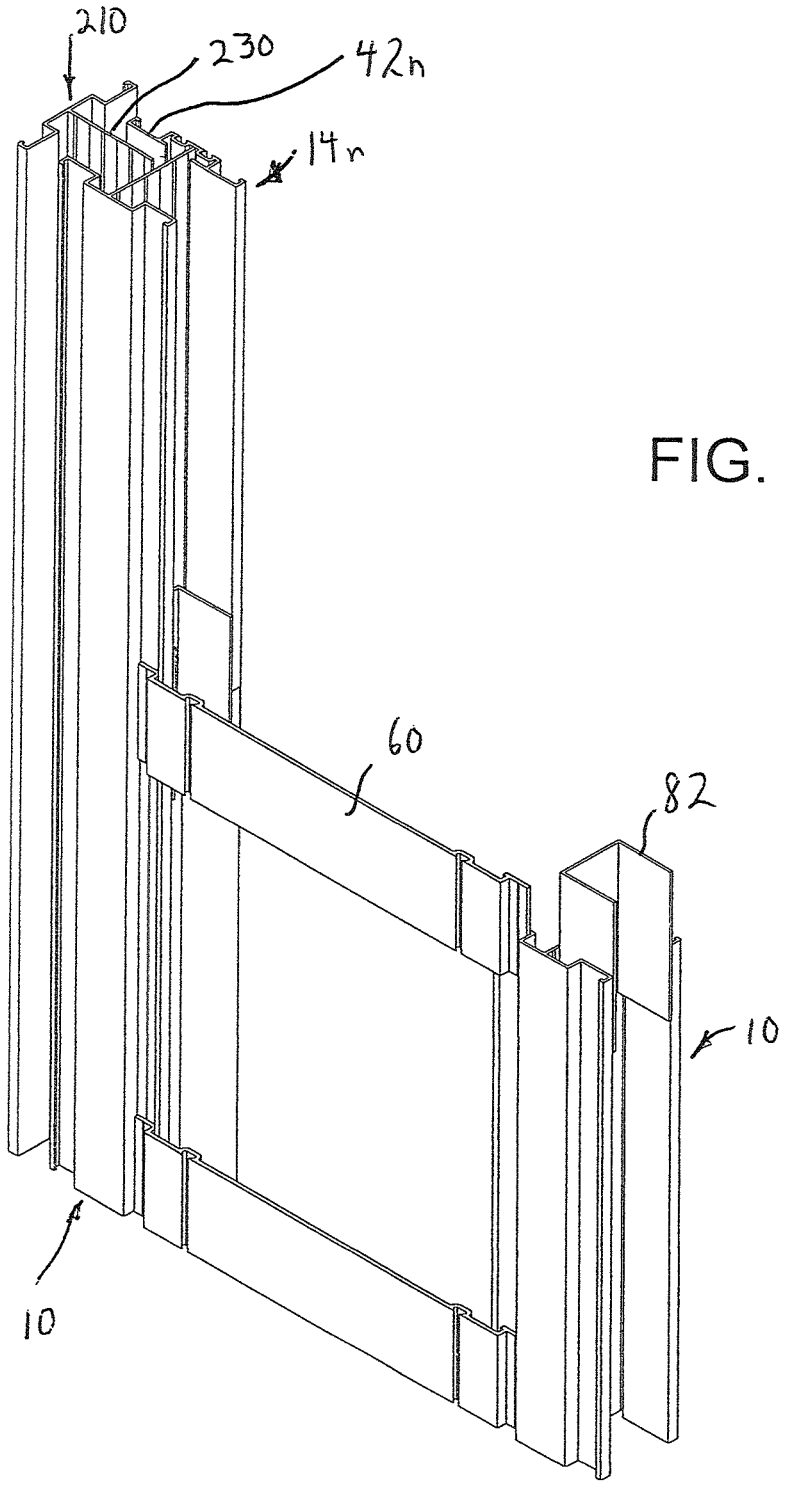
FIG. 18 is a perspective view of the studs connected together in a different arrangement at the corner.

It is also possible to secure the stud sections 10 to each other at a corner, and this is shown in FIG. 18. In this case, a modified first stud section 210 is identical to first stud section 10, except that planar retaining wall 32 is eliminated. In this case, elongated spacer wall 230 of modified first stud section 210 is positioned flush against a second planar resting wall 42*n* of a second stud section 14*n*, and can be secured thereto by screws or the like.

Figure 19:
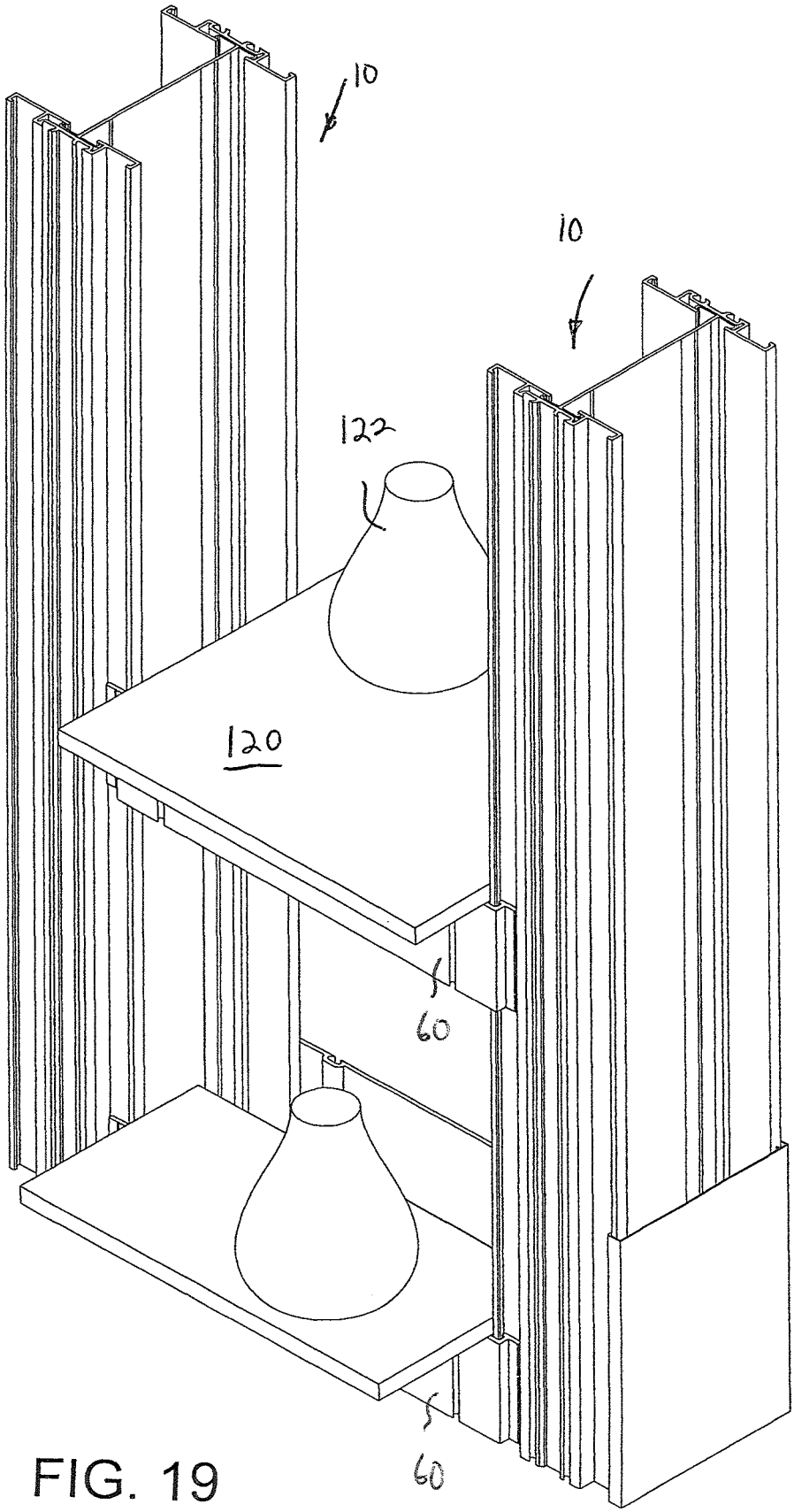
FIG. 19 is a perspective view of studs according to the present invention connected together to form shelving.

It will be appreciated that, although the above description has described the formation of studs 10 for securing wall panels 78 or sheetrock thereto, the present invention can be used in other situations, for example, in an exposed wall condition where there are no such wall panels 78. For example, shelves 120 can be mounted on the upper ends of spaced apart elongated side connecting panels 60 for displaying merchandise 122, as shown in FIG. 19.

It will be appreciated that all of the above elements can be made from any suitable materials, including, but not limited to, metal, aluminum, polyamide, etc.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A building construction, comprising:

a plurality of vertically oriented studs, each extending upwardly from a floor of a building, each stud including:

a first stud section including a first end flange and walls defining a recess, a second stud section including:

a second end flange in parallel, spaced apart relation to the first end flange of the first stud section, a retaining wall, and a connecting web wall which connects together the second end flange with the retaining wall, the connecting web wall being perpendicular to the second end flange and the retaining wall so as to maintain the second end flange and the retaining wall in parallel, spaced apart relation, the retaining wall slidably fit within the recess of the first stud section to connect said first stud section to said second stud section, at least one of the first and second end flanges including at least one wing wall and at least one side connecting panel, each side connecting panel connected directly to and between wing walls of horizontally spaced apart studs for connecting together said wing walls of said horizontally spaced apart studs, and each side connecting panel being substantially entirely in alignment with said wing walls.

2. The building construction according to claim 1, wherein:

the second end flange includes:

a central wall, and said at least one wing wall extending from a side edge of the central wall, the connecting web wall has one end fixedly connected to said central wall and forms part of the second stud section.

3. The building construction according to claim 1, further including connecting elements for connecting:

two first stud sections together in vertical alignment, and two second stud sections together in vertical alignment.

4. The building construction according to claim 1, further comprising shelving supported on two spaced apart side connecting panels for supporting items thereon.

5. The building construction according to claim 1, wherein said at least one of the first and second stud sections includes a central wall and two said wing walls extending from opposite side edges of the central wall.

6. The building construction according to claim 5, wherein at least one of the central wall and at least one side connecting panel include recesses extending along a lengthwise direction thereof, for receiving securing elements secured to a rear surface of a wall panel in order to mount the wall panel to the building construction.

7. The building construction according to claim 6, wherein there are two parallel, spaced apart said recesses in each central wall, and there are two parallel, spaced apart said recesses in each said side connecting panel.

8. The building construction according to claim 5, wherein both of the first and second stud sections include:

a central wall, and two said wing walls extending from opposite side edges of the central wall.

9. The building construction according to claim 8, further comprising a connecting element positioned between the connecting web wall and respective said wing walls of the first and second stud sections, the connecting element including an engaging section for engaging the connecting web wall of another first stud section, for forming a corner of a building.

10. The building construction according to claim 9, wherein the engaging section includes walls which surround, hold and engage the connecting web wall of the another first stud section.

11. The building construction according to claim 1, further comprising at least one of:

a top wall connected between two adjacent, spaced apart studs, and a bottom wall connected between two adjacent, spaced apart studs.

12. The building construction according to claim 11, wherein each top wall and bottom wall includes a central wall and opposite first and second end walls for engaging the connecting web wall of each respective said stud.

13. The building construction according to claim 12, wherein a first end of at least one of said top wall and said bottom wall includes an L-shaped wall extending from said first end wall for receiving a second end wall of another respective said top wall or bottom wall.

14. The building construction according to claim 12, further comprising an end wall securement member for engaging with a respective said connecting web wall, said end wall securement member including:

at least one wall for engaging with the respective said connecting web wall, and an L-shaped wall extending from said at least one wall for receiving a second end wall of a respective said top wall or bottom wall.

15. A building construction, comprising:

a plurality of vertically oriented studs, each extending upwardly from a floor of a building, each stud including:

a first stud section including a first end flange, a second stud section including a second end flange, and a connecting wall which connects together the first and second end flanges in a parallel, spaced apart relation, at least one of the first end flanges including at least one first wing wall, and at least one of the second end flanges including at least one second wing wall, at least one side connecting panel connecting together the wing walls of horizontally spaced apart studs, each connecting panel including a capture wall positioned at each end thereof, and wherein each said at least one wing wall includes a recess for slidably receiving one said capture wall therein for connecting said at least one side connecting panel to and between spaced apart said wing walls, such that each side connecting panel is in alignment with said wing walls.

16. A building construction, comprising:

a plurality of vertically oriented studs, each extending upwardly from a floor of a building, each stud including:

a first stud section including a first end flange, a second stud section including a second end flange, and a connecting wall which connects together the first and second end flanges in a parallel, spaced apart relation, at least one of the first end flanges including at least one first wing wall, and at least one of the second end flanges including at least one second wing wall, at least one side connecting panel connecting together the wing walls of horizontally spaced apart studs, each side connecting panel being in alignment with said wing walls, and wherein substantially an entire outer surface of each side connecting panel is coplanar with outer surfaces of said wing walls so as to be flush therewith.

* * * * *